US007174908B2

(12) United States Patent
Chen

(10) Patent No.: US 7,174,908 B2
(45) Date of Patent: Feb. 13, 2007

(54) MULTIPURPOSE NET FRAME

(76) Inventor: Benjamin Chen, No. 1-1, Lane156, Sec. 2, Changping Rd., Beitun District, Taichung City (TW)

( * ) Notice: Subject to any disclaimer, the term of this patent is extended or adjusted under 35 U.S.C. 154(b) by 491 days.

(21) Appl. No.: 10/844,656

(22) Filed: May 12, 2004

(65) Prior Publication Data

US 2005/0252541 A1 Nov. 17, 2005

(51) Int. Cl.
*E04H 15/40* (2006.01)
*E04H 15/44* (2006.01)

(52) U.S. Cl. ..... 135/135; 135/120.3; 403/109.3; 248/170

(58) Field of Classification Search ..... 135/138, 135/130, 135, 136, 137, 147, 159, 120.3; 403/109.3
See application file for complete search history.

(56) References Cited

U.S. PATENT DOCUMENTS 4,037,839 A * 7/1977 Nelson ..... 463/47.7
5,371,923 A * 12/1994 Chang ..... 16/113.1
2004/0163696 A1* 8/2004 Chen ..... 135/135

* cited by examiner

*Primary Examiner*—Tamara V. Graysay
*Assistant Examiner*—Danielle Jackson
(74) *Attorney, Agent, or Firm*—Charles E. Baxley

(57) ABSTRACT

A multipurpose net frame which is provided with a positioning device, the positioning device is slidably disposed on a control cord of the net frame; the user can set up the net frame by easily pushing the positioning device, when folding the net frame, the user can pull the positioning device and control cord to make positioning device move downward along the control rod, the respective rods and levers pivotally connected to the movable member are easily folded inward, and thus to prevent the user from being pinched when folding the net frame.

8 Claims, 11 Drawing Sheets

MULTIPURPOSE NET FRAME

BACKGROUND OF THE INVENTION

1. Field of the Invention

The present invention relates to a multipurpose net frame, which is provided with a positioning device, such that the net frame can be folded up and down more easily.

2. Description of the Prior Art

A conventional net frame is shown in FIGS. 1 and 2, wherein a coupling base 10 of the net frame is defined with a through hole 11, at an outer periphery of the coupling base 10 are provided with four rods 12, and at a predetermined position of the net frame are provided with plural levers 13 which are pivotally connected to a positioning member 14. The positioning member 14 is defined with a positioning portion 15. A control cord 16 has an end fixed to the positioning member 14 and has another free end passing through the through hole 11 of the coupling base 10. To set up the net frame, the user has to pull the free end of the control cord 16, the positioning member 14 is pulled to move by the control cord 16, so as to position the positioning portion 15 of the positioning member 14 in the through hole 11 of the coupling base 10. Meanwhile, the positioning member 14 will drive the respective rods 12 to move, by this way, the net frame is set up. To fold the net frame, the user has to push the respective levers 13 or pull the positioning member 14, and thus the positioning member 14 will make the respective rods 12 fold the net.

However, there are some defects in this conventional net frame structure. After the net frame is set up, the coupling base 10 and the positioning member 14 need to be positioned together in order to prevent the positioning portion 15 of the positioning member 14 from dropping from the through hole 11 of the coupling base 10, thereby it is necessary to additionally assemble a fixing element to the coupling base 10 and the positioning member 14. When pushing the respective levers 13 or pulling the positioning member in order to fold the net frame, the user will probably be pinched by the respective levers 13 and the positioning member 14.

The present invention has arisen to mitigate and/or obviate the afore-described disadvantages of the conventional net frame.

SUMMARY OF THE INVENTION

The primary object of the present invention is to provide a multipurpose net frame, wherein a coupling base is provided with a control cord, a positioning device is slidably disposed on the control cord and located bellow the coupling base, the positioning device has a movable member pivotally connected with plural levers, the levers link to plural rods. By such arrangements, the user can hold the positioning device with one hand while pulling the control cord with another hand, so as to push the positioning device easily, and thus the net frame is set up.

The secondary object of the present invention is to provide a multipurpose net frame. When folding the net frame, the user can pull the pulling member of the positioning device to make the through hole of the pulling member move downward along the control cord, the respective rods and levers pivotally connected to the movable member will be folded inward, and thus to prevent the user being pinched when folding the net frame.

The present invention will become more obvious from the following description when taken in connection with the accompanying drawings, which shows, for purpose of illustrations only, the preferred embodiments in accordance with the present invention.

DETAILED DESCRIPTION OF THE PREFERRED EMBODIMENTS

Figure 1:
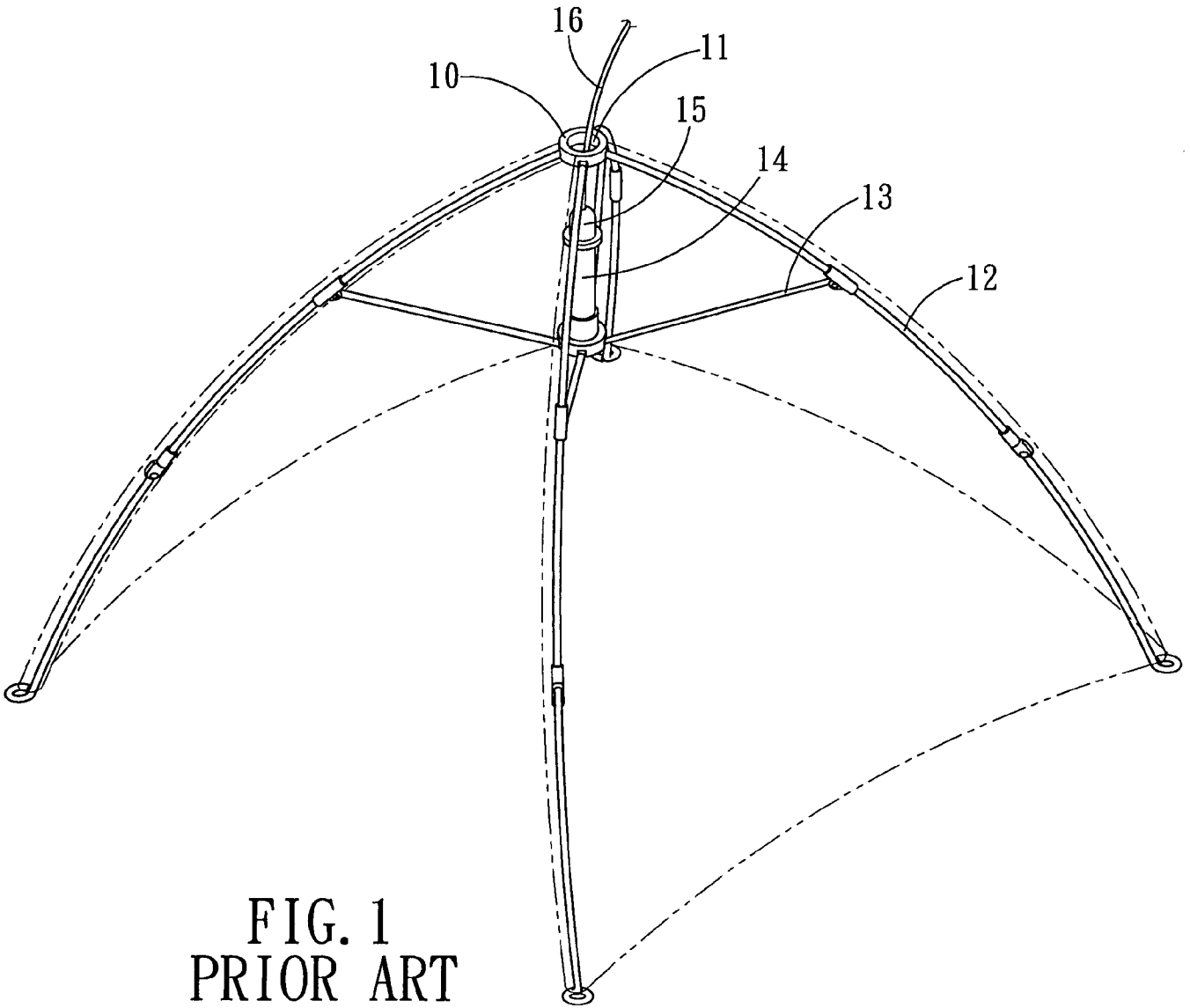
FIG. 1 PRIOR ART
FIG. 1 is a perspective view of a conventional net frame when it is not set up.
Figure 2:
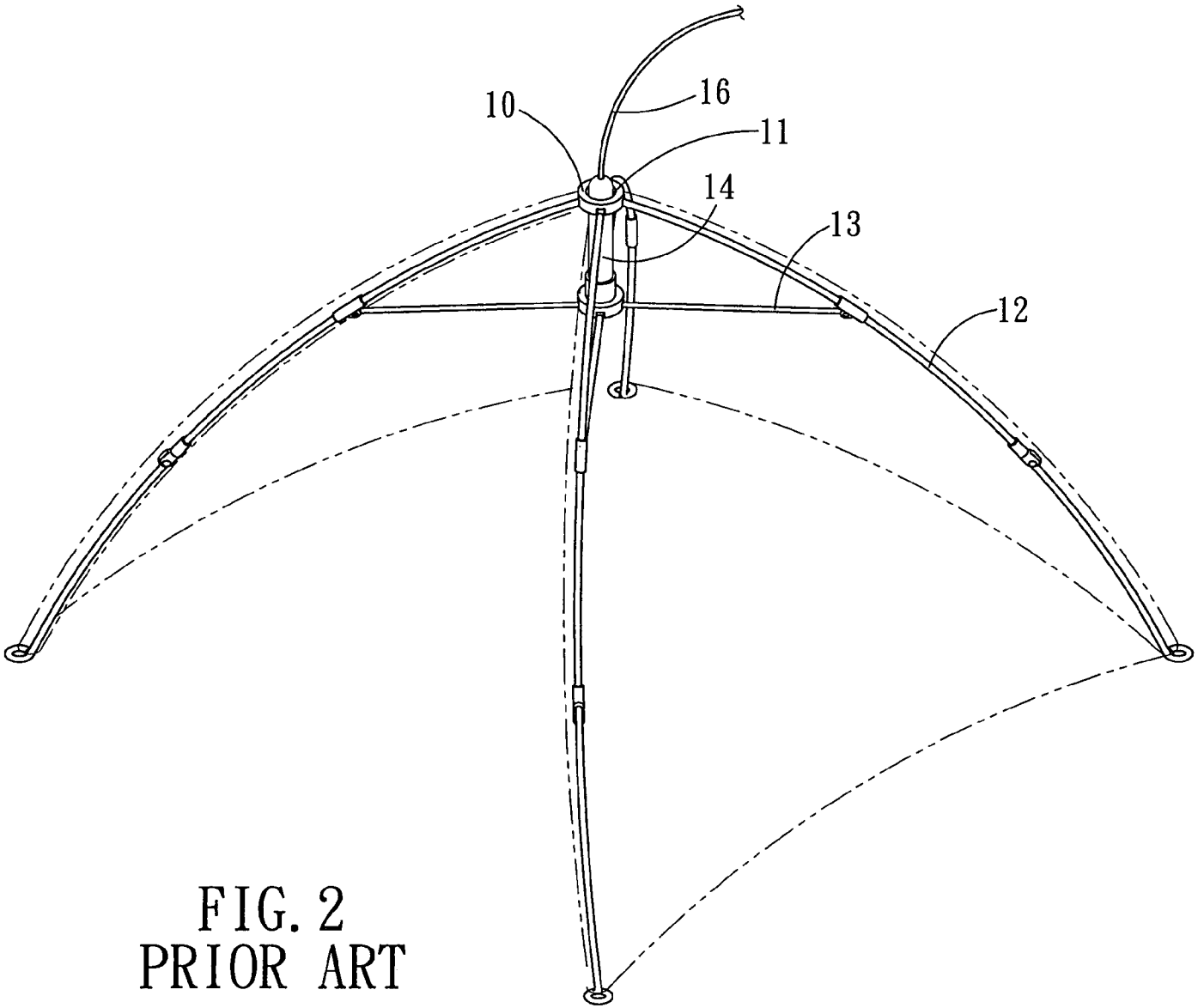
FIG. 2 PRIOR ART
FIG. 2 is a perspective view of a conventional net frame when it is set up.
Figure 3:
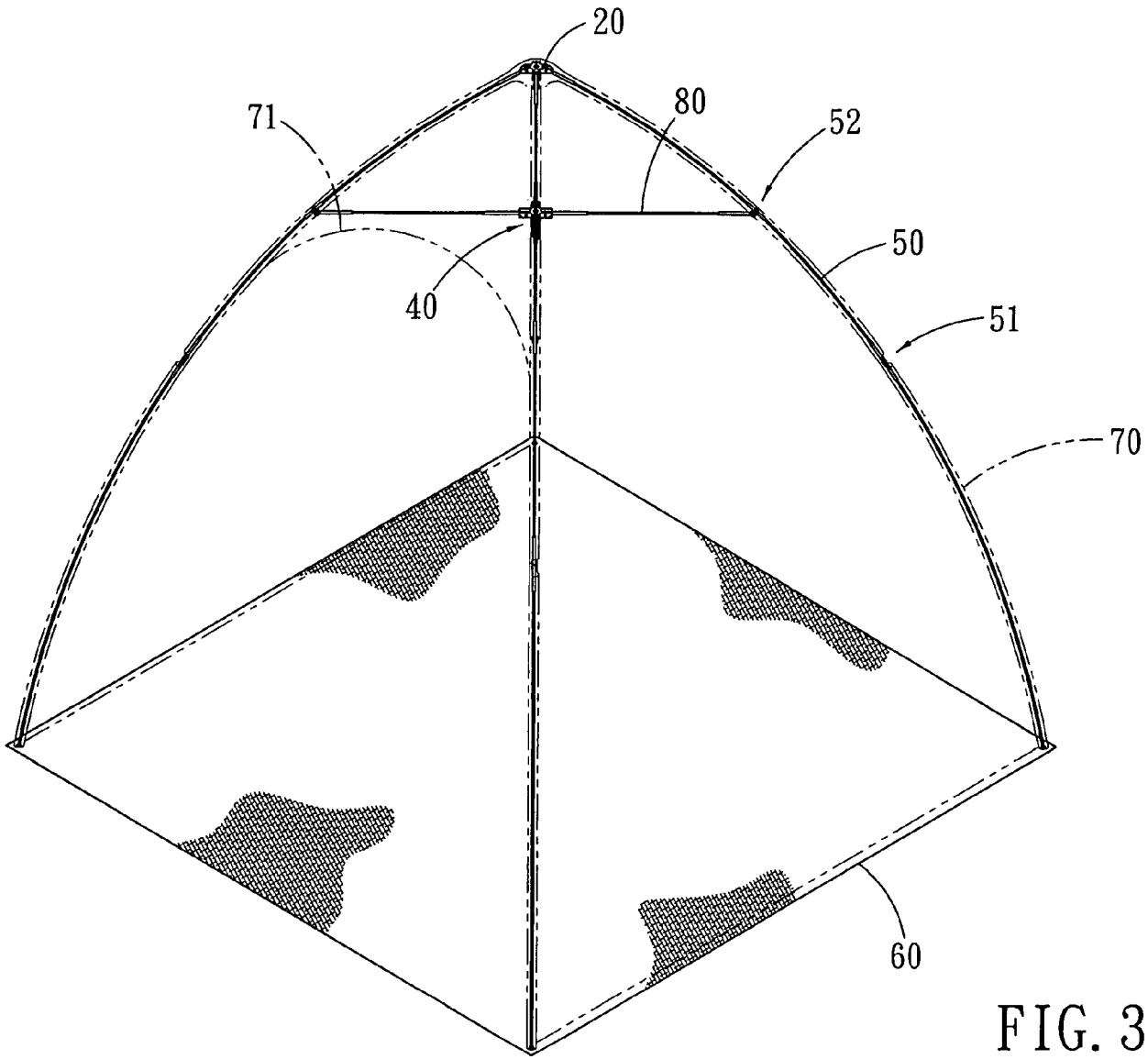
FIG. 3 is a perspective assembly view of a multipurpose net frame in accordance with one aspect of the present invention.
Figure 4:
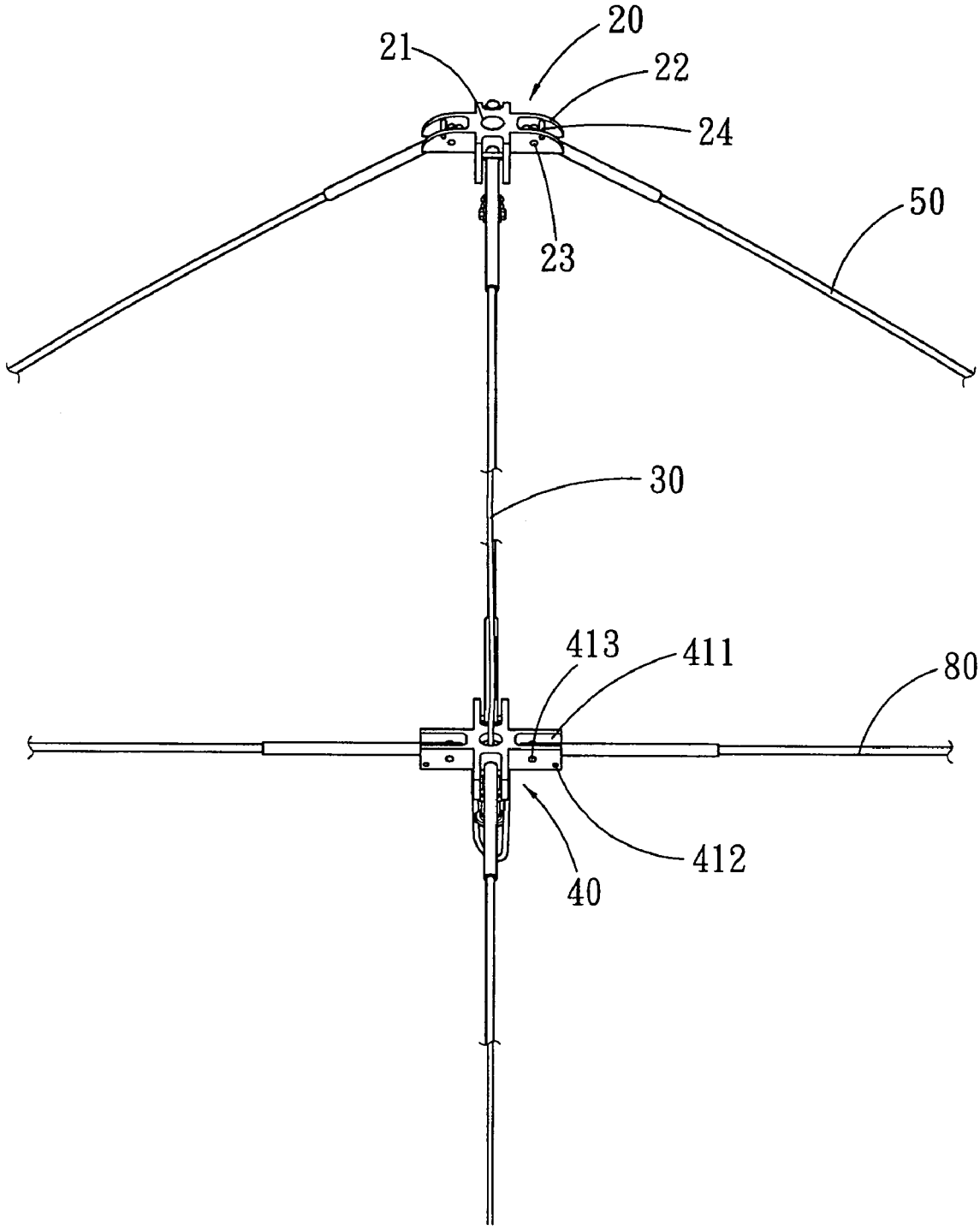
FIG. 4 is a partial perspective view of a multipurpose net frame in accordance with one aspect of the present invention.

Referring to FIGS. 3 and 4, wherein a multipurpose net frame is shown and generally comprised of a coupling base 20, a control cord (or rod) 30, a positioning device 40, four rods 50, a cloth 60, a net 70 and four levers 80.

The coupling base 20 is defined at a center thereof with a through hole 21, about periphery of the coupling base 20 is equidistantly provided with four coupling portions 22 which are parallel in pairs. Each of the four coupling portions 22 is formed at a predetermined position thereof with coupling holes 23. Between each paired parallel coupling portions 22 is defined with a stopper 24.

The control cord 30 has a first end fixed to the through hole 21 of the coupling base 20, and a second end of the control cord 30 is a free end.

Figure 5:
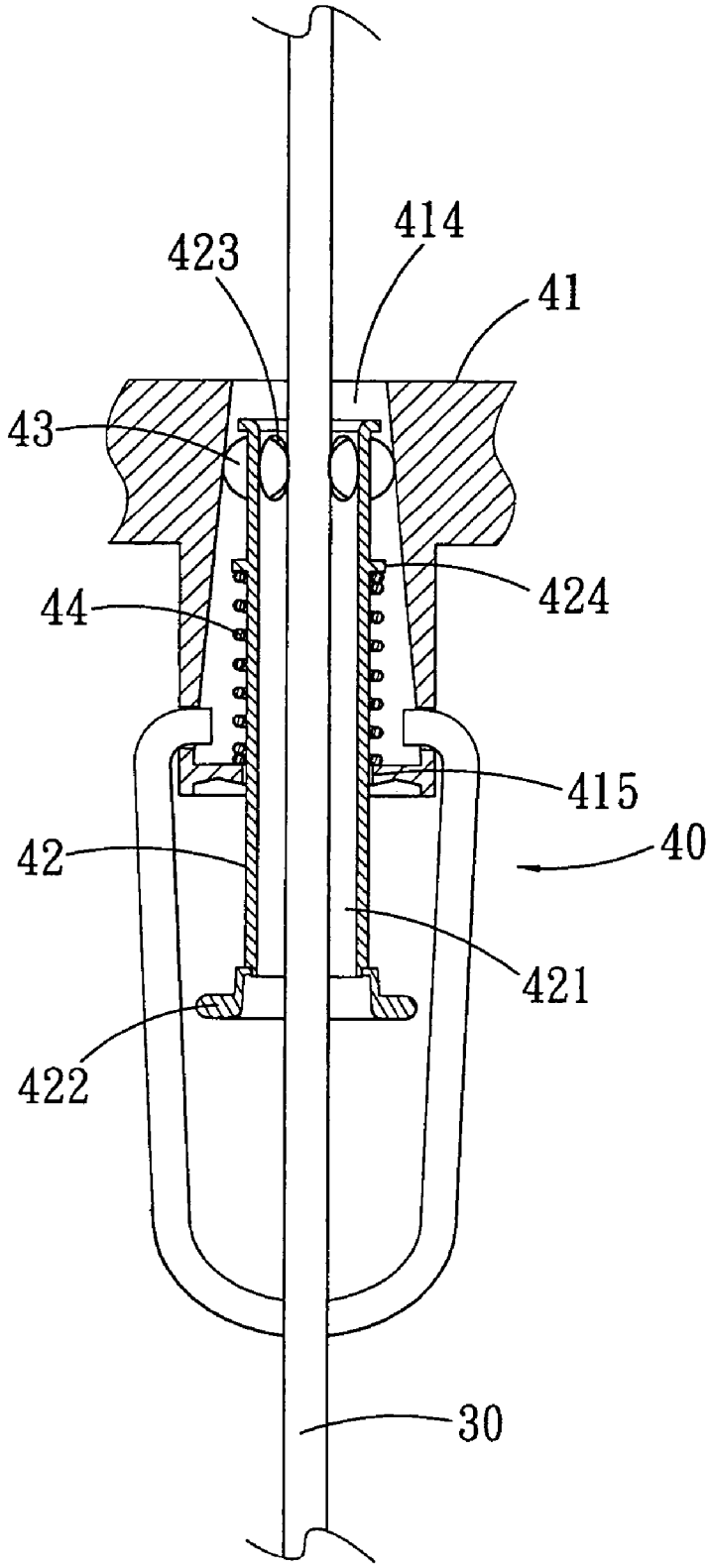
FIG. 5 is a partial cross sectional view of a multipurpose net frame in accordance with one aspect of the present invention.

The positioning device 40 comprises a movable member 41, a pulling member 42, three rolling elements 43 and an elastic member 44 (as shown in FIGS. 4 and 5). About a periphery of the movable member 41 are provided with four coupling portions 411 which are parallel in pairs, and between each paired parallel coupling portions 411 is defined with a stopper 412. Each of the coupling portions 411 is provided at a predetermined position thereof with a hole 413. The center of the movable member 41 is defined with a conical groove 414, and at a bottom of the conical groove 414 an aperture 415 is defined. The pulling member 42 is defined at a first end surface thereof with a through aperture 421, at the first end of the pulling member 42 is provided with a handle portion 422, and on a periphery of a second end of the pulling member 42 are equidistantly defined with three through holes 423 for the reception of the rolling elements 43. A protrusion (or projection) 424 is defined at a predetermined position of the periphery of the pulling member 42. The second end of the pulling member 42, equipped with the rolling elements 43, serves to insert in the conical groove 414 of the movable member 41, and the first end of the pulling member 42 defined with handle portion 422 protrudes out of the aperture 415 of the movable member 41. The elastic member 44 is disposed around an outer periphery of the pulling member 42 in a manner that an end of the elastic member 44 presses against a bottom of the conical groove 414 of the movable member 41 and another end of the elastic member 44 abuts against the protrusion 424 of the pulling member 42. The through aperture 421 of the pulling member 42 of the positioning device 40 is provided for the insertion of the control cord 30, and the rolling elements 43 in the pulling member 42 are used to clamp the control cord 30 from respective sides.

Figure 6:
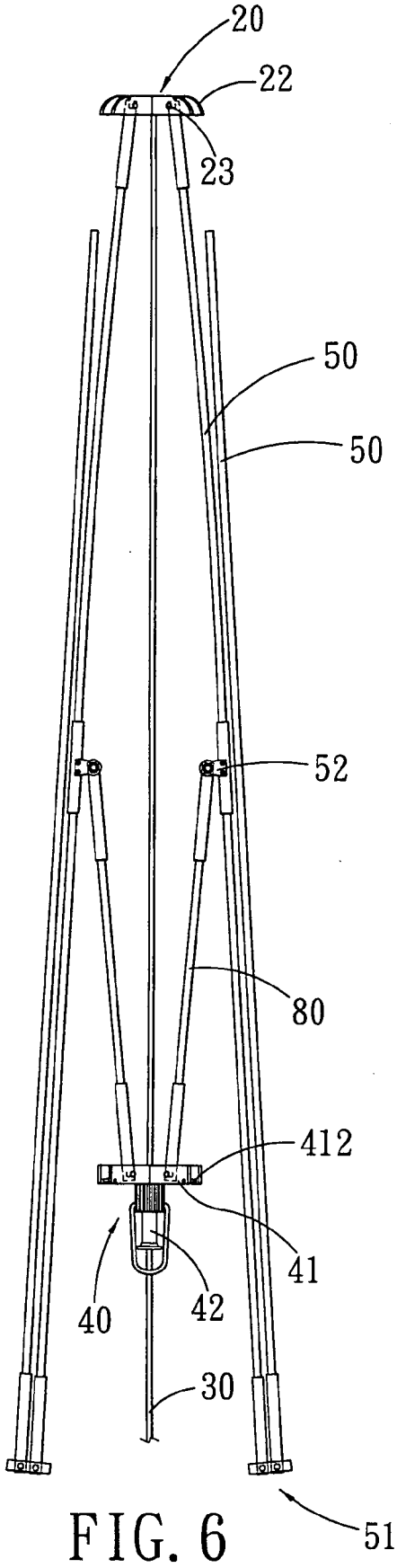
FIG. 6 is a side view of a multipurpose net frame in accordance with one aspect of the present invention wherein the net frame is folded.

The four rods 50 have identical structure, at a predetermined position of the respective rods 50 is provided with a pivoting portion 51, such that the rods 50 can be folded down and up, as shown in FIG. 6, the respective rods 50 are further provided with a connecting portion 52. A first end of the respective rods 50 is inserted in the coupling holes 23 of the parallel coupling portions 22 on the coupling base 20.

Figure 7:
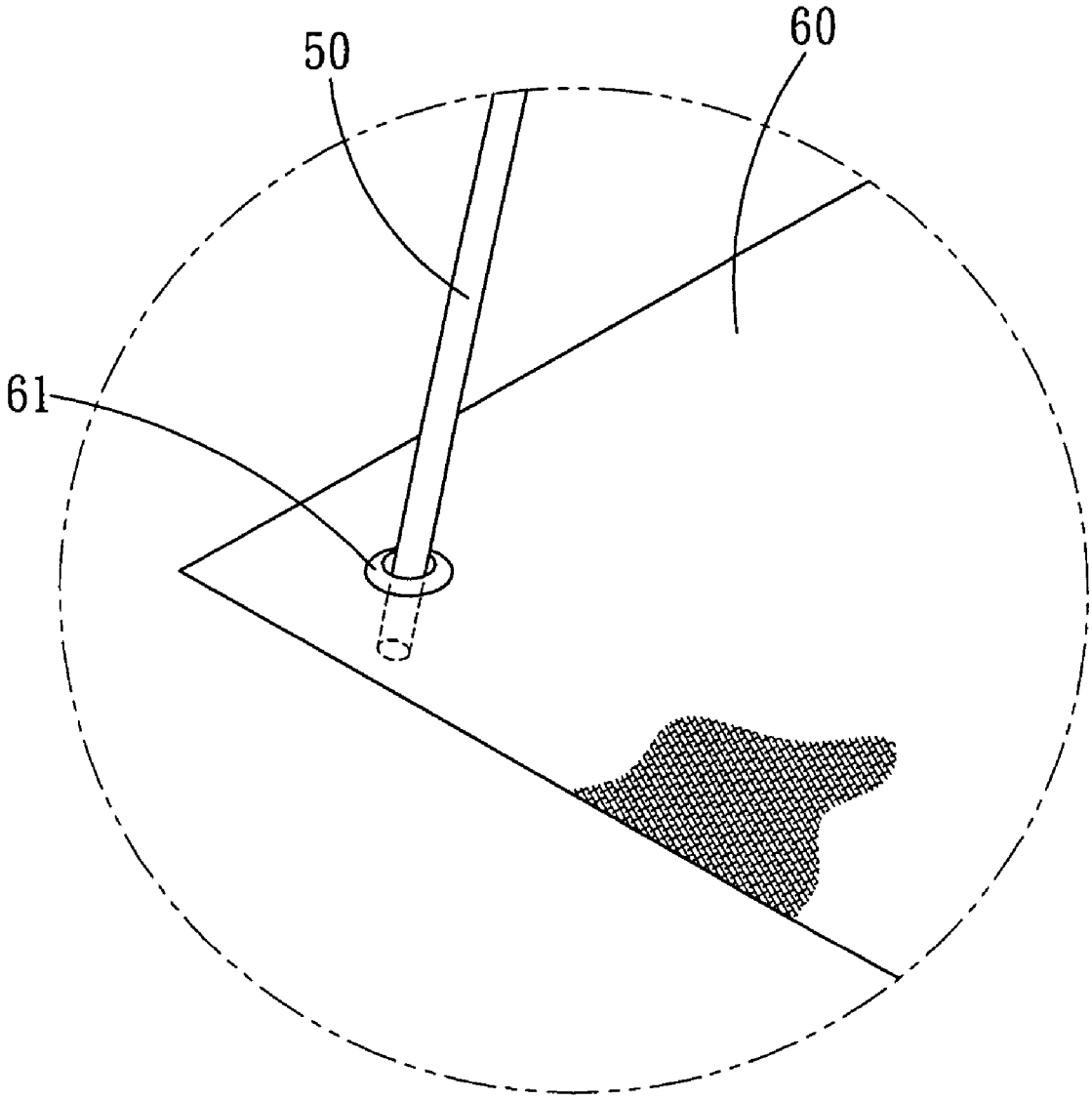
FIG. 7 is a partial amplified view of a multipurpose net frame in accordance with one aspect of the present invention.

The cloth 60, at each corner of which is provided with a hollow annular member 61 for the reception of a second end of the respective rods 50 (as shown in FIG. 7).

The net 70 is disposed between the respective rods 50 and connected with the cloth 60, and a reverse "U"-shaped gap is defined between two neighboring rods 50.

The levers 80 have identical structure, and each has a first end pivotally connected to the connecting portion 52 of the rods 50 and has a second end pivotally connected to the hole 413 of the respective coupling portions 411 on the movable member 41 of the positioning device 40.

Figure 8:
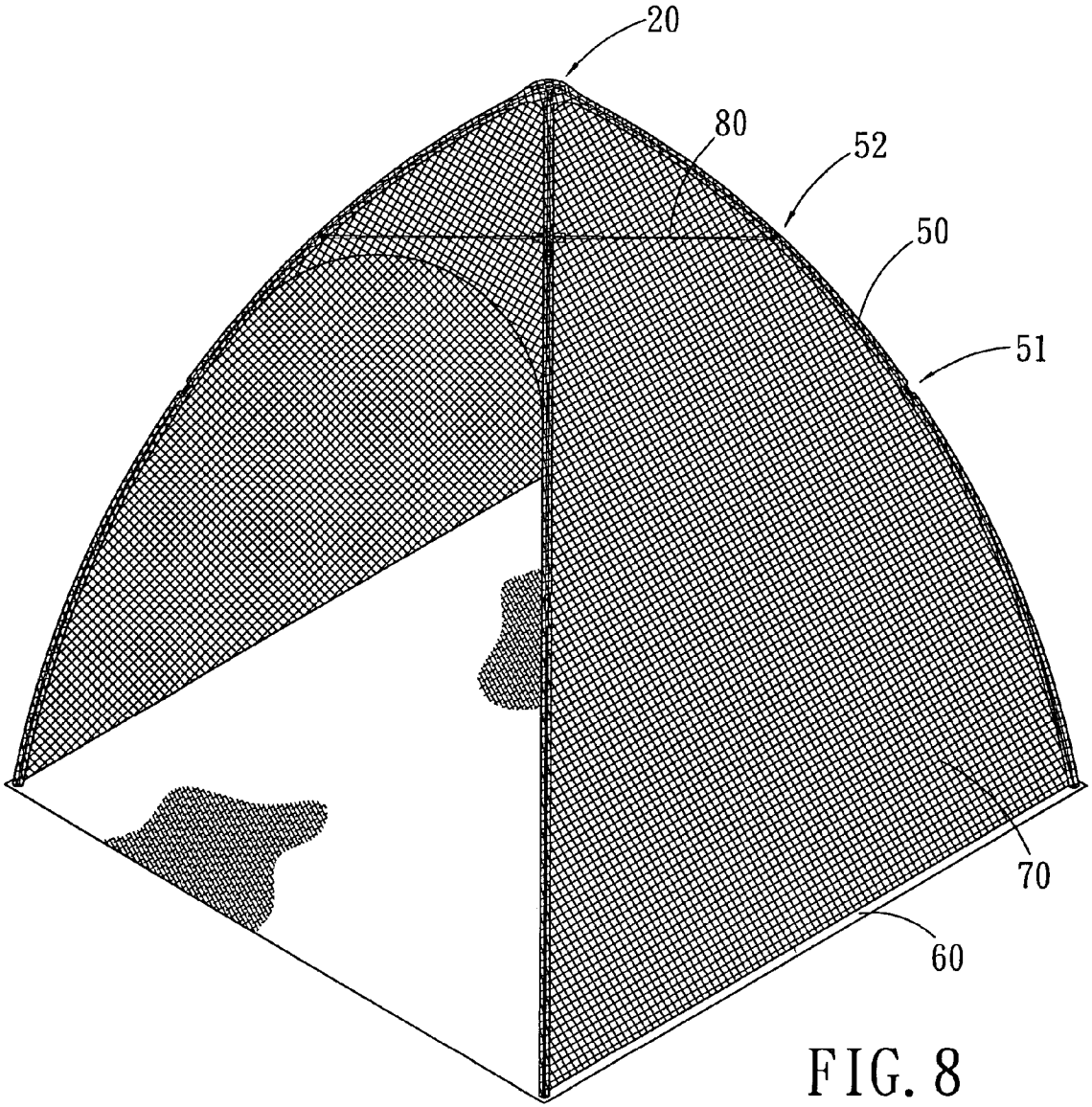
FIG. 8 is another perspective view of a multipurpose net frame in accordance with one aspect of the present invention.

Referring to FIGS. 4, 5 and 8, to set up the net frame, the user can hold the positioning device 40 with one hand while pulling the control cord 30 with another hand, the positioning device 40 is pulled to slide by the control cord 30, such that the movable member 41 of the positioning device 40 can make the respective levers 80 move, and then the levers 80 push the respective rods 50 to move, the through aperture 421 of the pulling member 42 of the positioning member 40 moves upward along the control cord 30 until the stopper 412 at the coupling portions 411 of the movable member 41 abut against the levers 80, or until the stopper 24 of the coupling base 20 is touched by the rods 50. By this way, the net frame is set up.

Since the elastic member 44 elastically presses against the protrusion 424 of the pulling member 42, the rolling elements 43 disposed in the pulling member 42 are able to abut against the wall of the conical groove 414 of the movable member 41. And due to the conical groove 414 is wider at the bottom and tapers off toward the top, when the positioning device 40 moves upward or when the control cord 30 is pulled downward, the rolling elements 43 on the pulling member 42 will not be pressed by the wall of the conical groove 414 of the movable member 41. In this case, the control cord 30 can enable the rolling elements 43 on the pulling member to freely rotate and roll in the pulling direction of the control cord 30.

Figure 9:
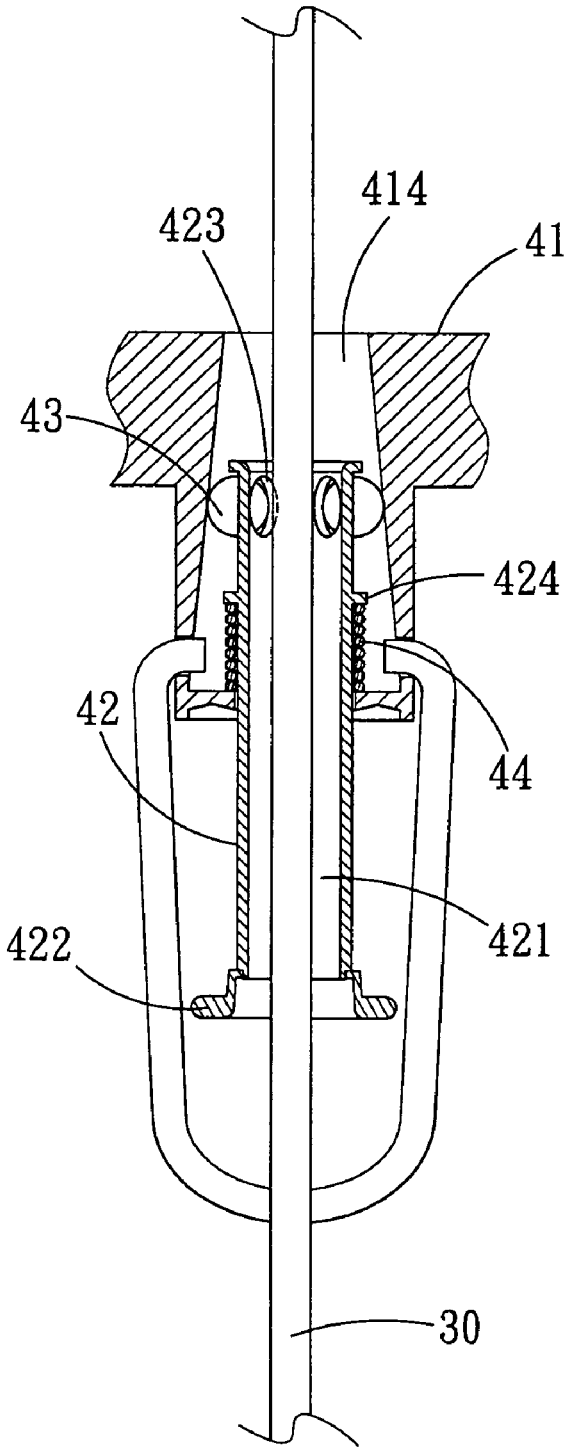
FIG. 9 is another partial cross sectional view of a multipurpose net frame in accordance with one aspect of the present invention.
Figure 10:
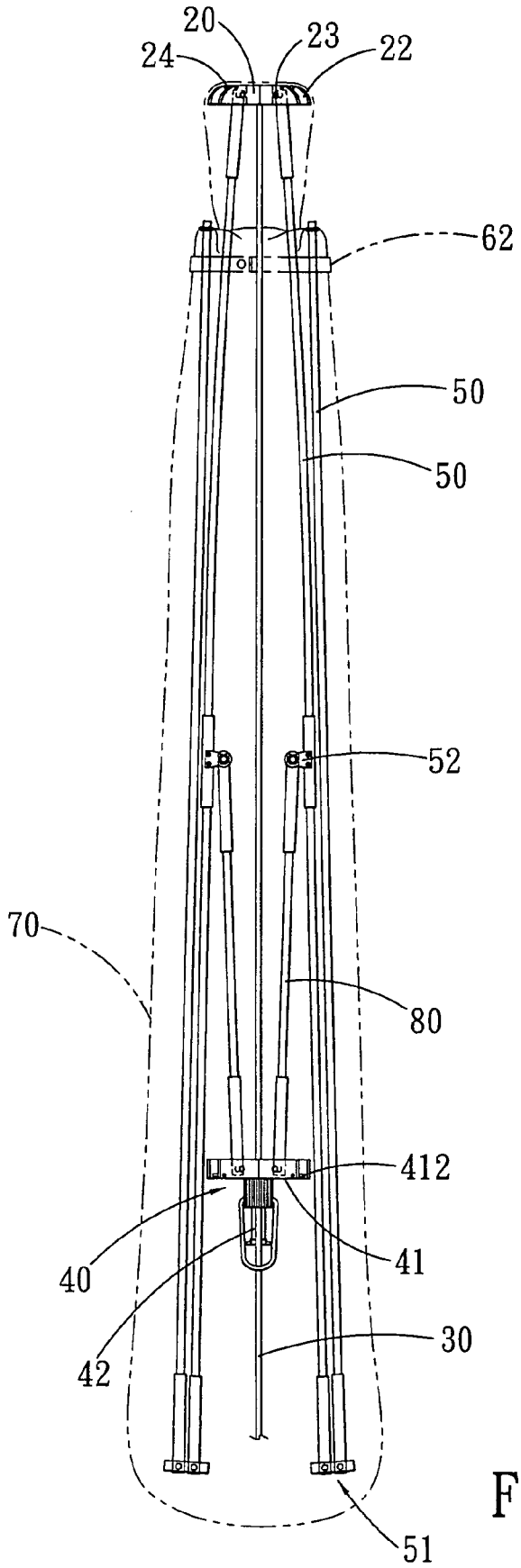
FIG. 10 is another side view of a multipurpose net frame in accordance with one aspect of the present invention wherein the net frame is folded.

Referring to FIGS. 9 and 10, to fold the net frame, the user can pull the pulling member 42 of the positioning device 40, so as to compress the elastic member 44 with the protrusion 424 of the pulling member 42 and the bottom of the conical groove 414 of the movable member 41, and thus the positioning device 40 is able to slide downward along the control cord 30, so as further to fold the respective levers 80 of the movable member 41 and the rods 50 of the coupling base 20. In addition, on the cloth 60 can be provided with a binding member 62 that is used to bind the net frame after it is folded. Such that the user is prevented from being pinched by the levers 80 and the positioning device 40.

Figure 11:
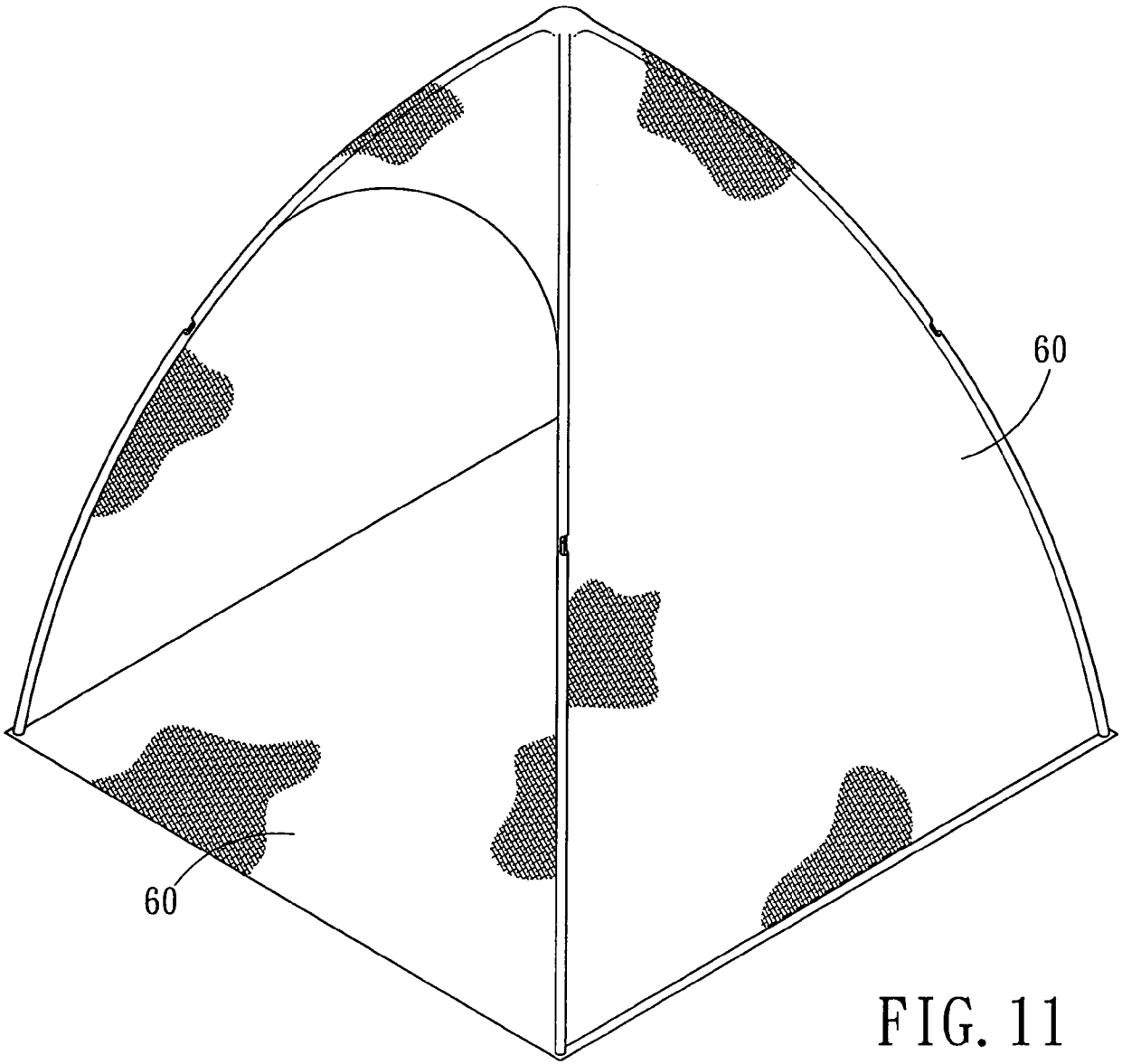
FIG. 11 is a perspective view of a multipurpose net frame in accordance with another embodiment of the present invention.

Referring to FIG. 11, wherein the net 70 between the rods 50 can be replaced by cloth 60, such that the corresponding products in according with the present invention can be net for ball games and also can be tent.

While we have shown and described various embodiments in accordance with the present invention, it should be clear to those skilled in the art that further embodiments may be made without departing from the scope of the present invention.

What is claimed is:

1. A multipurpose net frame, comprising:

a coupling base, at a periphery of which provided with plural coupling portions;

a control cord having a first end connected to the coupling base and having a free end;

a positioning device having a movable member, a pulling member, at least one rolling element and an elastic member, on a periphery of the movable member provided with plural coupling portions corresponding to the plural coupling portions of the coupling base, at a center of the movable member defined with a groove, at a bottom of the groove defined with an aperture, the pulling member defined at a first end surface thereof with a through aperture, on an outer periphery of the pulling member at least defined with a through hole for reception of the rolling element, protrusions defined on the outer periphery of the pulling member, an end of the pulling member equipped with the rolling element serving to insert in the groove of the movable member and the pulling member partially protruding out of the aperture of the movable member, the elastic member disposed around the outer periphery of the pulling member in a manner that an end of the elastic member pressing against the bottom of the groove of the movable member and another end of the elastic member abutting against the protrusion of the pulling member, the through aperture of the pulling member of the positioning device provided for insertion of the control cord, and the rolling element in the pulling member used to clamp the control cord from a respective side;

plural rods each having an end pivotally connected to the respective coupling portions of the coupling base;

plural levers each having a first end pivotally connected to a connecting portion of the respective rods and having a second end pivotally connected to the coupling portions of the movable member of the positioning device.

2. The multipurpose net frame as claimed in claim 1, wherein the respective coupling portions of the coupling base are provided with a stopped for limiting pivoting movement of the rods.

3. The multipurpose net frame as claimed in claim 1, wherein the respective coupling portions of the movable member are provided with a stopper for limiting pivoting movement of the levers.

4. The multipurpose net frame as claimed in claim 1, wherein the groove of the movable member of the positioning device is conical shaped and is wider at the bottom and tapers off toward the top.

5. The multipurpose net frame as claimed in claim 1, wherein a handle portion is provided at the first end of the pulling member for the user to pull the pulling member.

6. The multipurpose net frame as claimed in claim 1, wherein a cloth is disposed between ends of the respective rods.

7. The multipurpose net frame as claimed in claim 1, wherein a net is disposed between the rods.

8. The multipurpose net frame as claimed in claim 1, wherein a cloth is disposed between the rods, such that the net frame can be used as a tent.

* * * * *